US008041236B2

(12) United States Patent
Kim et al.

(10) Patent No.: US 8,041,236 B2
(45) Date of Patent: Oct. 18, 2011

(54) FIXING UNIT CONTROLLING APPARATUS AND IMAGE FORMING APPARATUS INCLUDING THE SAME

(75) Inventors: Jin-ha Kim, Seongnam-si (KR); Kyung-hwan So, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 390 days.

(21) Appl. No.: 12/406,998

(22) Filed: Mar. 19, 2009

(65) Prior Publication Data

US 2010/0054766 A1 Mar. 4, 2010

(51) Int. Cl.
*G03G 15/20* (2006.01)

(52) U.S. Cl. ..... 399/33; 399/67; 399/69

(58) Field of Classification Search ..... 399/9, 33, 399/37, 38, 67, 69, 70; 219/216, 619
See application file for complete search history.

(56) References Cited

U.S. PATENT DOCUMENTS 7,127,189 B2 * 10/2006 Takamatsu et al. ..... 399/69
7,164,870 B2 * 1/2007 Satoh ..... 399/69

* cited by examiner

*Primary Examiner* — Hoan Tran
(74) *Attorney, Agent, or Firm* — Stanzione & Kim, LLP

(57) ABSTRACT

A fixing unit controlling apparatus that includes a switching unit of a power supplier to supply power to a fixing unit according to a power supply controlling signal to control a temperature of the fixing unit, and a switching unit of a power shutter to shut off power supplied to the fixing unit when the fixing unit controlling apparatus operates abnormally, wherein the switching units of the power supplier and the power shutter are both connected to a snubber circuit of the power shutter.

21 Claims, 2 Drawing Sheets

FIXING UNIT CONTROLLING APPARATUS AND IMAGE FORMING APPARATUS INCLUDING THE SAME

CROSS-REFERENCE TO RELATED APPLICATIONS

This application claims the benefit of Korean Patent Application No. 10-2008-0085913, filed on Sep. 1, 2008, in the Korean Intellectual Property Office, the disclosure of which is incorporated herein in its entirety by reference.

BACKGROUND OF THE INVENTION

1. Field of the Invention

The present general inventive concept relates to a fixing unit controlling apparatus and an image forming apparatus including the same.

2. Description of the Related Art

When an apparatus receiving a voltage from a switching mode power supply (SMPS) operates abnormally, for example, when a surge voltage is generated in the apparatus, internal elements included in the apparatus might be damaged. In other words, a product liability (PL) accident might happen due to the large increases in current and voltage. In particular, a PL accident might frequently occur in a fixing unit controlling apparatus that controls a fixing unit which includes a heater. In order to prevent a PL accident, a relay that is switched on/off when an apparatus operates abnormally is used to prevent internal elements of the apparatus from being damaged. In this case, however, harmonics noise is generated due to chattering when the relay is switched on/off. The apparatus cannot operate normally due to the harmonics noise.

SUMMARY OF THE INVENTION

The present general inventive concept provides a fixing unit controlling apparatus preventing noise and a product liability (PL) accident, and an image forming apparatus including the fixing unit controlling apparatus.

Additional aspects and utilities of the present general inventive concept will be set forth in part in the description which follows and, in part, will be obvious from the description, or may be learned by practice of the general inventive concept.

Embodiments of the present general inventive concept can be achieved by providing a fixing unit controlling apparatus to control a fixing unit, the apparatus including a power supplier that may include a first switching unit that is switched to an on or off state according to a power supply controlling signal to control a temperature of the fixing unit, and a second switching unit that is switched to an on or off state according to the state of the first switching unit to control power supplied to the fixing unit; and a power shutter that may include a snubber circuit that may include a resistor and a capacitor, an inductor, and a third switching unit that is switched to an on or off state according to an external control signal, in order to shut-off power supplied to the fixing unit when the fixing unit controlling apparatus operates abnormally, wherein the third switching unit and the second switching unit may both be connected to the snubber circuit.

Embodiments of the present general inventive concept can also be achieved by providing a fixing unit controlling apparatus to control a fixing unit, the apparatus including a switching unit to control power supplied to the fixing unit; a relay switched to an on or off state according to an external control signal generated when the fixing unit controlling apparatus operates abnormally; a snubber circuit that may include a resistor and a capacitor; and an inductor, wherein the switching unit and the relay may be connected in series, wherein the snubber circuit may be connected in parallel to a circuit in which the switching unit and the relay are connected in series, and wherein the inductor may be connected in series to the relay.

Embodiments of the present general inventive concept can also be achieved by providing an image forming apparatus including a fixing unit that may include at least one heater to fix an image to printing paper; and a fixing unit controlling apparatus to control a temperature of the heater, wherein the a fixing unit controlling apparatus may include a power supplier that may include a first switching unit switched to an on or off state according to a power supply controlling signal for to control a temperature of the fixing unit, and a second switching unit switched to an on or off state according to the state of the first switching unit to control power supplied to the fixing unit; and a power shutter that may include a snubber circuit that may include a resistor and a capacitor, an inductor, and a third switching unit that is switched to an on or off state according to an external control signal, in order to shut-off power supplied to the fixing unit when the fixing unit controlling apparatus operates abnormally, wherein the third switching unit and the second switching unit may both be connected to the snubber circuit.

According to another aspect Embodiments of the present general inventive concept can also be achieved by providing an electric device including a switching unit to control power supplied to a predetermined heater; a relay switched to an on or off state according to an external control signal generated when the power is abnormally supplied to the predetermined heater; a snubber circuit that may include a resistor and a capacitor; and an inductor, wherein the switching unit and the relay may both be connected to the snubber circuit.

The third switching unit and the second switching unit may be connected in series, and the snubber circuit may be connected in parallel to a circuit in which the third switching unit and the second switching unit are connected in series.

The inductor may be connected to the third switching unit in series.

The external control signal may be generated when the fixing unit controlling apparatus operates abnormally.

The first switching unit may include a light emitting device, and a light receiving device coupled to the light emitting device to be activated.

The second switching unit may include a triac.

The third switching unit may include a relay.

Embodiments of the present general inventive concept can also be achieved by providing a control method of an electric device, the control method including: receiving an external control signal at a circuit including a relay, switching the relay to an on or off state according to the external control signal, reducing noise through a snubber circuit and an inductor, the snubber circuit being connected in parallel to the circuit, and the inductor being connected in series to the relay, and controlling a power supply to be cut off if the external control signal indicates the electric device is operating abnormally.

The controlling of the power supply may further include switching a switching unit to an on or off state according to a power supply signal, wherein the circuit further includes the switching unit, and the switching unit is connected in series with the relay.

The switching of the switching unit to the off state may cut off the power supply to the electric device.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
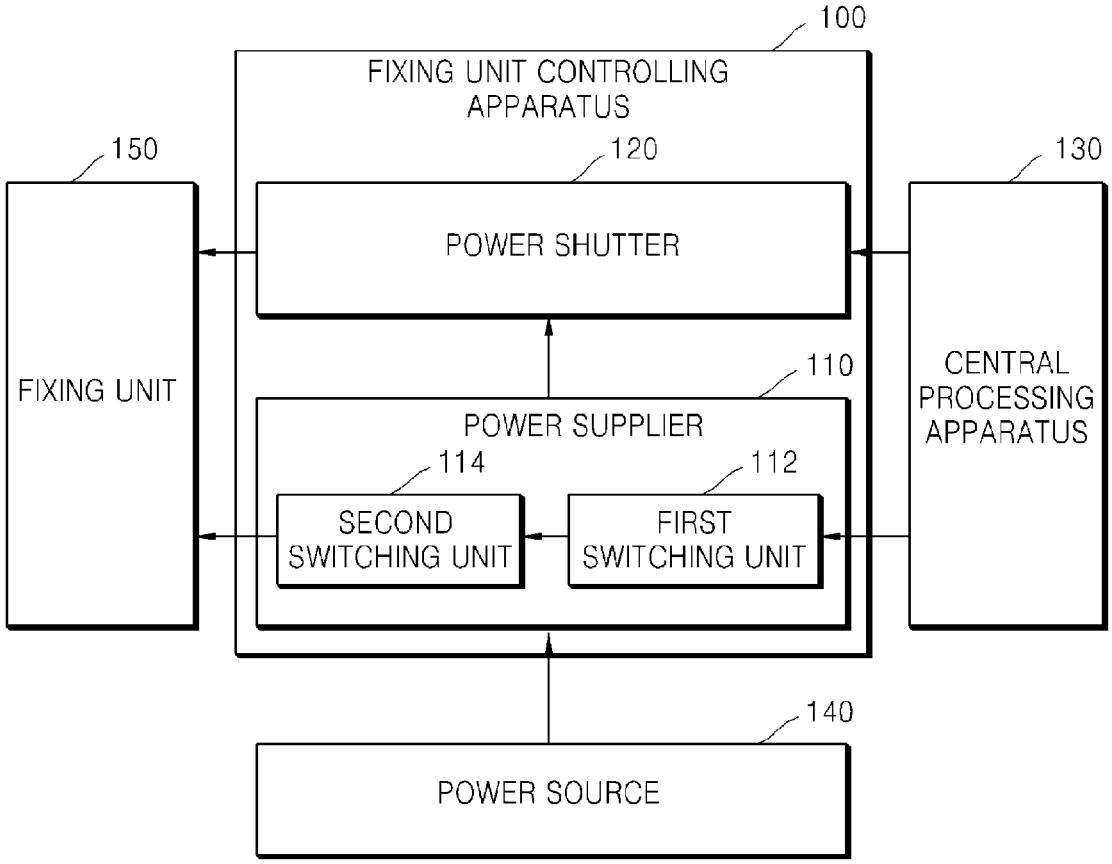
FIG. 1 is a block diagram for explaining a fixing unit controlling apparatus, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram of a fixing unit controlling apparatus 100, according to an embodiment of the present general inventive concept.

The fixing unit controlling apparatus 100 may include a power supplier 110 and a power shutter 120.

The power supplier 110 supplies power to a fixing unit 150 according to a power supply controlling signal to control a temperature of the fixing unit 150. In particular, the power supplier 110 receives AC power output from a power source 140, and supplies the power to the fixing unit 150 according to the power supply controlling signal output from a central processing apparatus 130. The power source 140 converts AC power output from a switching mode power supply (SMPS) to a predetermined voltage level required by the fixing unit controlling apparatus 100 and outputs the voltage at the predetermined level. The power supplier 110 may include a first switching unit 112 that receives the power supply controlling signal output from the central processing apparatus 130 and is switched on/off according to the power supply controlling signal, and a second switching unit 114 that is switched on/off according to the on/off state of the first switching unit 112 to control power supplied to the fixing unit 150.

The power shutter 120 shuts-off power supplied to the fixing unit 150 when the fixing unit controlling apparatus 100 operates abnormally. In particular, when the fixing unit controlling apparatus 100 operates abnormally, the power shutter 120 receives an external control signal output from the central processing apparatus 130 and shuts-off power supplied to the fixing unit 150 according to the external control signal.

Figure 2:
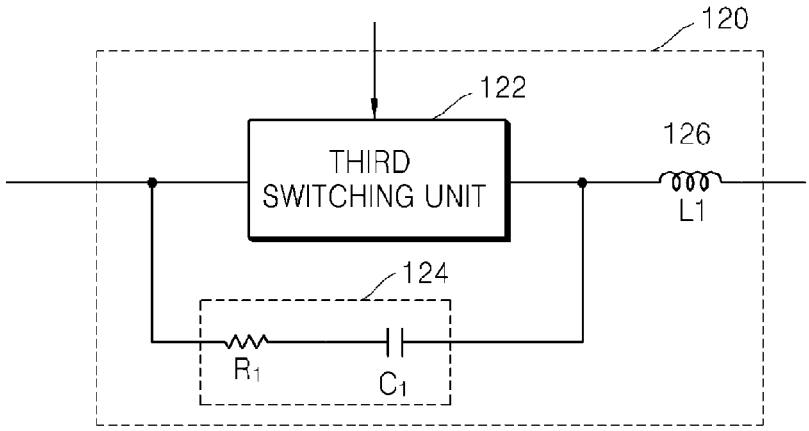
FIG. 2 illustrates internal elements of a power shutter of the fixing unit controlling apparatus of FIG. 1, according to an embodiment of the present general inventive concept.

FIG. 2 illustrates internal elements of the power shutter 120 of the fixing unit controlling apparatus 100 of FIG. 1, according to an embodiment of the present general inventive concept. Hereinafter, the internal elements included in the power shutter 120 will be described.

The power shutter 120 may include a third switching unit 122, a snubber circuit 124, and an inductor 126.

The third switching unit 122 may include a relay 128, and shuts-off power supplied to the fixing unit 150 by switching-on/off a contact point of the third switching unit 122 according to the external control signal output from the central processing apparatus 130. The central processing apparatus 130 outputs the external control signal when the fixing unit controlling apparatus 100 operates abnormally. For example, the fixing unit controlling apparatus 100 may operate abnormally when a surge voltage output from the power source 140 is input to the fixing unit controlling apparatus 100. The third switching unit 122 receives the external control signal to shut-off power supplied to the fixing unit 150. At this time, the third switching unit 122, which includes a relay 128, physically switches off a contact point of the third switching unit 122 according to the external control signal. In other words, since power is shut off by the switching operation of the relay 128, even if a surge voltage output from the power source 140 is input to the fixing unit controlling apparatus 100, elements included in the fixing unit controlling apparatus 100 are not damaged.

The snubber circuit 124 may include a first resistor R1 and a first capacitor C1. The snubber circuit 124 is connected in parallel to the third switching unit 122. In addition, the inductor 126 is connected in series to the third switching unit 122.

Figure 3:
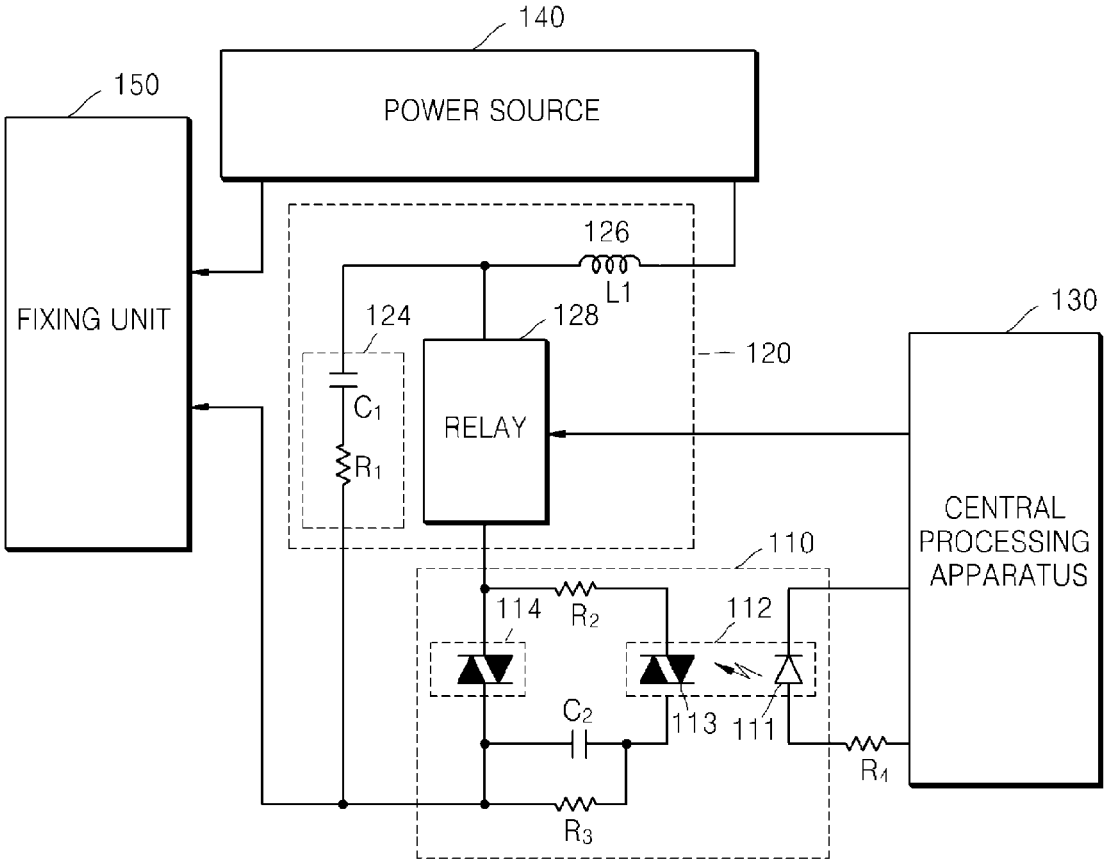
FIG. 3 is a circuit diagram of the fixing unit controlling apparatus of FIG. 1, according to an embodiment of the present general inventive concept.

FIG. 3 is a circuit diagram of the fixing unit controlling apparatus 100 of FIG. 1, according to an embodiment of the inventive concept.

Hereinafter, the fixing unit controlling apparatus 100 and an operation of the fixing unit controlling apparatus 100 will be described with reference to FIG. 3.

The central processing apparatus 130 controls all operations of the fixing unit controlling apparatus 100, and outputs the power supply controlling signal for controlling the temperature of the fixing unit 150.

The power supplier 110 may include the first switching unit 112 and the second switching unit 114. The first switching unit 112 may include a light emitting device 111 and a light receiving device 113 (e.g., a photo-triac) coupled to the light emitting device 111 to be activated. The light emitting device 111 generates a light beam according to the power supply controlling signal output from the central processing apparatus 130. The light beam is input to the light receiving device 113 to activate the light receiving device 113. Thus, the first switching unit 112 is switched on/off to form a current path, according to whether the light receiving device 113 is activated or not. The light receiving device 113 is disposed to correspond to the light emitting device 111.

The second switching unit 114 may include a triac. The second switching unit 114 is synchronized with the light receiving device 113 of the first switching unit 112 to be activated. In other words, when the light receiving device 113 is activated, the first switching unit 112 is switched on to output a current. Then, the current is input to the second switching unit 114, and accordingly the second switching unit 114 is activated to be switched on. Thus, power output from the power source 140 is supplied to the fixing unit 150.

The power shutter 120 may include a third switching unit 122, the snubber circuit 124, and the inductor 126. The third switching unit 122 may include a relay 128. The snubber circuit may include a first resistor R1 and a first capacitor C1

The relay 128 and the second switching unit 114 share the snubber circuit 124. In particular, the relay 128 is connected in series to the second switching unit 114. The snubber circuit 124 is connected in parallel to a circuit in which the relay 128 is connected in series to the second switching unit 114. A connection point between the second switching unit 114 and the snubber circuit 124 is connected to the fixing unit 150.

One node of the inductor 126 is connected in series to the relay 128. In addition, the other node of the inductor 126 is connected to the power source 140.

When the fixing unit controlling apparatus 100 operates abnormally, the central processing apparatus 130 outputs an external control signal, which is then input to the relay 128. Contact points of the relay 128 are physically switched on/off according to the external control signal. That is, since power is shut-off by the physical switching operation of the relay 128, even if a surge voltage output from power source 140 is input to the fixing unit controlling apparatus 100, elements included in the fixing unit controlling apparatus 100 can be prevented from being damaged.

However, when the contact points of the relay 128 are physically switched on/off, harmonics noise might be generated due to chattering. Likewise, the harmonics noise generated during the switching-on/off of the contact points of the relay 128 adversely affects an image forming system sensitive to noise, and thus jitter phenomenon may be generated. However, in the present embodiment, the fixing unit controlling apparatus 100 may remove noise through the snubber circuit 124 and the inductor 126 included in the power shutter 120.

In particular, in the power shutter 120 of the fixing unit controlling apparatus 100, since the snubber circuit 124 including the first capacitor C1 and the first resistance R1 is connected in parallel to a circuit in which the relay 128 and the second switching unit 114 are connected in series, peak noise is smoothed. In particular, the component dV/dt of a harmonics noise voltage generated when the contact points of the relay 128 are switched on/off can be reduced by the snubber circuit 124 that is shared by the second switching unit 114 and the relay 128.

In the power shutter 120 of the fixing unit controlling apparatus 100, since the inductor 126 is connected in series to the relay 128, the component dI/dt of a harmonics noise current flowing to an input node of the power source 140 can be reduced.

As mentioned above, the power shutter 120 of the fixing unit controlling apparatus 100 includes the relay 128 connected in series to the second switching unit 114, the snubber circuit 124 connected to the circuit in which the relay 128 is connected in series to the second switching unit 114, and the inductor 126 connected in series to the relay 128. In this example, elements included in the fixing unit controlling apparatus 100 can be prevented from being damaged even if a surge voltage output from power source 140 is input to the fixing unit controlling apparatus 100. When the contacts of the relay 128 are physically switched on/off, harmonics noise that might be generated due to chattering can be reduced or even eliminated.

The fixing unit 150 may include at least one heater so as to fix an image formed on printing paper. Accordingly, an image forming apparatus may include the fixing unit 150 and the fixing unit controlling apparatus 100 to reduce or eliminate harmonics noise due to chattering. In addition, the present general inventive concept may be embodied in an electronic device using the power supplier 110 and power shutter 120 of FIG. 3. In this case, the power supplier 110 may include a switching unit to control power supplied to a predetermined heat source.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fixing unit controlling apparatus to control a fixing unit, the apparatus comprising:
- a power supplier comprising:
  - a first switching unit that is switched to an on or off state according to a power supply controlling signal to control a temperature of the fixing unit, and
  - a second switching unit that is switched to an on or off state according to the state of the first switching unit to control power supplied to the fixing unit; and
- a power shutter comprising:
  - a snubber circuit including a resistor and a capacitor, an inductor, and
  - a third switching unit that is switched to an on or off state according to an external control signal, in order to shut-off power supplied to the fixing unit when the fixing unit controlling apparatus operates abnormally,
- wherein the third switching unit and the second switching unit are both connected to the snubber circuit.

2. The fixing unit controlling apparatus of claim 1, wherein the third switching unit and the second switching unit are connected in series, and
- wherein the snubber circuit is connected in parallel to a circuit in which the third switching unit and the second switching unit are connected in series.

3. The fixing unit controlling apparatus of claim 2, wherein the inductor is connected in series to the third switching unit.

4. The fixing unit controlling apparatus of claim 1, wherein the external control signal is generated when the fixing unit controlling apparatus operates abnormally.

5. The fixing unit controlling apparatus of claim 1, wherein the first switching unit comprises:
- a light emitting device and a light receiving device coupled to the light emitting device to be activated.

6. The fixing unit controlling apparatus of claim 1, wherein the second switching unit comprises a triac.

7. The fixing unit controlling apparatus of claim 1, wherein the third switching unit comprises a relay.

8. A fixing unit controlling apparatus to control a fixing unit, the apparatus comprising:
- a switching unit to control power supplied to the fixing unit;
- a relay switched to an on or off state according to an external control signal generated when the fixing unit controlling apparatus operates abnormally;
- a snubber circuit comprising a resistor and a capacitor; and an inductor,
- wherein the switching unit and the relay are connected in series,
- wherein the snubber circuit is connected in parallel to a circuit in which the switching unit and the relay are connected in series, and
- wherein the inductor is connected in series to the relay.

9. An image forming apparatus comprising:
- a fixing unit comprising at least one heater to fix an image to printing paper; and
- a fixing unit controlling apparatus to control a temperature of the heater,
- wherein the fixing unit controlling apparatus comprises:
  - a power supplier comprising:
    - a first switching unit switched to an on or off state according to a power supply controlling signal to control a temperature of the fixing unit, and
    - a second switching unit switched to an on or off state according to the state of the first switching unit to control power supplied to the fixing unit; and a power shutter comprising:

a snubber circuit that includes a resistor and a capacitor, an inductor, and a third switching unit that is switched to an on or off state according to an external control signal, in order to shut-off power supplied to the fixing unit when the fixing unit controlling apparatus operates abnormally, wherein the third switching unit and the second switching unit are both connected to the snubber circuit.

10. The image forming apparatus of claim 9, wherein the third switching unit and the second switching unit are connected in series, and wherein the snubber circuit is connected in parallel to a circuit in which the third switching unit and the second switching unit are connected in series.

11. The image forming apparatus of claim 10, wherein the inductor is connected to the third switching unit in series.

12. The image forming apparatus of claim 9, wherein the external control signal is generated when the fixing unit controlling apparatus operates abnormally.

13. The image forming apparatus of claim 9, wherein the first switching unit comprises:

a light emitting device and a light receiving device coupled to the light emitting device to be activated.

14. The image forming apparatus of claim 9, wherein the second switching unit comprises a triac.

15. The image forming apparatus of claim 9, wherein the third switching unit comprises a relay.

16. An electric device comprising:

a switching unit to control power supplied to a predetermined heater;

a relay switched to an on or off state according to an external control signal generated when the power is abnormally supplied to the predetermined heater;

a snubber circuit comprising a resistor and a capacitor; and an inductor, wherein the switching unit and the relay are both connected to the snubber circuit.

17. The electric device of claim 16, wherein the relay and the switching unit are connected in series, and wherein the snubber circuit is connected in parallel to a circuit in which the switching unit and the relay are connected in series.

18. The electric device of claim 16, wherein the inductor is connected in series to the relay.

19. A control method of an electric device, the control method comprising:

receiving an external control signal at a circuit including a relay;

switching the relay to an on or off state according to the external control signal;

reducing noise through a snubber circuit and an inductor, the snubber circuit being connected in parallel to the circuit and the inductor being connected in series to the relay; and controlling a power supply to be cut off if the external control signal indicates the electric device is operating abnormally.

20. The control method of claim 19, wherein the controlling of the power supply further includes switching a switching unit to an on or off state according to a power supply controlling signal, wherein the circuit further includes the switching unit, and the switching unit is connected in series with the relay.

21. The control method of claim 19, wherein the switching of the switching unit to the off state cuts off the power supply to the electric device.

* * * * *

UNITED STATES PATENT AND TRADEMARK OFFICE

CERTIFICATE OF CORRECTION

PATENT NO. : 8,041,236 B2
APPLICATION NO. : 12/406998
DATED : October 18, 2011
INVENTOR(S) : Jin-ha Kim et al.

It is certified that error appears in the above-identified patent and that said Letters Patent is hereby corrected as shown below:

Title Page, please insert;

Section --(30) Foreign Application Priority Data

September 1, 2008 (KR).....10-2008-0085913--

Signed and Sealed this
Third Day of July, 2012

David J. Kappos

David J. Kappos
*Director of the United States Patent and Trademark Office*